US010619845B2

(12) United States Patent
Dumas

(10) Patent No.: US 10,619,845 B2
(45) Date of Patent: Apr. 14, 2020

(54) COOLED CERAMIC ELECTRODE SUPPORTS

(71) Applicant: CLEARSIGN COMBUSTION CORPORATION, Seattle, WA (US)

(72) Inventor: Jesse Dumas, Seattle, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 120 days.

(21) Appl. No.: 15/666,941

(22) Filed: Aug. 2, 2017

(65) Prior Publication Data

US 2018/0051874 A1 Feb. 22, 2018

Related U.S. Application Data

(60) Provisional application No. 62/376,662, filed on Aug. 18, 2016.

(51) Int. Cl.
*F23C 99/00* (2006.01)

(52) U.S. Cl.
CPC ..... *F23C 99/001* (2013.01)

(58) Field of Classification Search
CPC ..... F23C 99/001; F23N 5/265; F23N 5/00; F23N 5/242; F02M 27/04
See application file for complete search history.

(56) References Cited

U.S. PATENT DOCUMENTS 2,374,610 A 4/1945 MacLaren, Jr.
2,405,807 A * 8/1946 Arant ..... F23N 5/20 431/66
2,412,373 A * 12/1946 Wejnarth ..... H01B 1/00 252/516
2,412,374 A * 12/1946 Wejnarth ..... H01B 1/00 252/516
2,412,375 A * 12/1946 Wejnarth ..... H01B 1/00 252/516
2,412,376 A * 12/1946 Wejnarth ..... H01B 1/00 252/516

(Continued)

FOREIGN PATENT DOCUMENTS

JP 58-019609 2/1983
JP 3678937 B2 * 8/2005 ..... C04B 38/00

(Continued)

OTHER PUBLICATIONS

JP-3678937-B2—English translation (Year: 2005).*

*Primary Examiner* — Jorge A Pereiro
(74) *Attorney, Agent, or Firm* — Christopher A. Wiklof; James C. Larsen; Launchpad IP, Inc.

(57) ABSTRACT

A combustion system includes a burner assembly, an electrode positioned within a combustion volume and configured to apply electrical energy to a flame supported by the burner assembly, and a dielectric electrode support extending through a furnace wall into the combustion volume and configured to support the electrode and further configured to be cooled by a coolant fluid circulated therethrough. The electrode support has coolant ports in fluid communication with a coolant channel extending within electrode support. During operation of the combustion system, a fluid coolant flows through the electrode support, holding a temperature of the electrode to within a selected range.

29 Claims, 5 Drawing Sheets

(56) References Cited

U.S. PATENT DOCUMENTS 2,445,296 A * 7/1948 Wejnarth ..... H01B 1/00 252/516
2,975,145 A * 3/1961 Harris ..... H01B 1/08 252/520.2
3,037,942 A * 6/1962 Ingold ..... H01C 7/022 252/519.51
3,207,953 A * 9/1965 Smith ..... F23Q 3/006 361/253
3,245,457 A * 4/1966 Smith ..... F23D 11/42 431/6
3,446,902 A * 5/1969 Akers ..... F27D 11/08 373/90
3,475,352 A * 10/1969 Yerouchalmi ..... C04B 35/50 252/520.2
3,707,644 A * 12/1972 Hirt ..... H01J 37/32 219/121.36
4,327,282 A * 4/1982 Nauerth ..... H05B 3/10 219/505
4,332,295 A * 6/1982 LaHaye ..... F28F 21/04 165/178
4,652,318 A * 3/1987 Masuda ..... B03C 7/04 156/89.19
4,831,432 A * 5/1989 Hori ..... H01C 1/1406 257/43
4,867,848 A * 9/1989 Cordier ..... C10B 1/04 201/6
5,046,144 A * 9/1991 Jensen ..... C03B 5/005 219/121.36
5,183,101 A * 2/1993 Penaluna ..... F25B 41/04 165/104.33
5,529,651 A * 6/1996 Yoshida ..... C04B 35/64 156/85
5,620,616 A 4/1997 Anderson et al.
5,702,244 A 12/1997 Goodson et al.
5,784,889 A 7/1998 Joos et al.
6,166,903 A * 12/2000 Ranchy ..... H01L 23/473 361/690
6,610,964 B2 * 8/2003 Radmacher ..... F23Q 7/001 123/145 A
6,887,069 B1 5/2005 Thornton et al.
7,927,095 B1 4/2011 Chorpening et al.
8,385,041 B2 * 2/2013 Goudy, Jr. ..... B03C 3/08 361/230
8,411,406 B2 * 4/2013 Goudy, Jr. ..... B03C 3/08 361/230
8,851,882 B2 * 10/2014 Hartwick ..... F23C 99/001 431/2
8,881,535 B2 11/2014 Hartwick et al.
8,901,467 B2 * 12/2014 Radmacher ..... B28B 1/008 123/145 A
8,911,699 B2 12/2014 Colannino et al.
9,062,882 B2 6/2015 Hangauer et al.
9,151,549 B2 10/2015 Goodson et al.
9,209,654 B2 12/2015 Colannino et al.
9,243,800 B2 1/2016 Goodson et al.
9,267,680 B2 2/2016 Goodson et al.
9,284,886 B2 3/2016 Breidenthal et al.
9,289,780 B2 3/2016 Goodson
9,310,077 B2 4/2016 Breidenthal et al.
9,366,427 B2 6/2016 Sonnichsen et al.
9,371,994 B2 6/2016 Goodson et al.
9,377,188 B2 6/2016 Ruiz et al.
9,377,189 B2 6/2016 Ruiz et al.
9,377,195 B2 6/2016 Goodson et al.
9,441,834 B2 9/2016 Colannino et al.
9,453,640 B2 9/2016 Krichtafovitch et al.
9,469,819 B2 10/2016 Wiklof
9,494,317 B2 11/2016 Krichtafovitch et al.
9,496,688 B2 * 11/2016 Krichtafovitch ..... F23C 99/001
9,513,006 B2 12/2016 Krichtafovitch et al.
9,562,681 B2 2/2017 Colannino et al.
9,574,767 B2 2/2017 Anderson et al.
9,664,386 B2 5/2017 Krichtafovitch
9,696,034 B2 7/2017 Krichtafovitch et al.
9,702,547 B2 7/2017 Krichtafovitch et al.
9,702,550 B2 7/2017 Colannino et al.
9,732,958 B2 8/2017 Wiklof
9,739,479 B2 8/2017 Krichtafovitch et al.
9,746,180 B2 8/2017 Krichtafovitch et al.
10,006,715 B2 * 6/2018 Colannino ..... F27B 9/2469
2002/0056548 A1 * 5/2002 Nakamura ..... B24B 57/02 165/154
2002/0113151 A1 * 8/2002 Forber Jones ..... B01J 2/02 239/690
2004/0147986 A1 7/2004 Baumgardner et al.
2007/0020567 A1 1/2007 Branston et al.
2008/0179033 A1 * 7/2008 Forbes Jones ..... B22F 9/14 164/46
2008/0179034 A1 * 7/2008 Forbes Jones ..... B01J 2/04 164/46
2009/0038958 A1 * 2/2009 Coyle ..... B01J 4/002 205/628
2010/0067164 A1 * 3/2010 Goudy, Jr. ..... B03C 3/08 361/225
2010/0147676 A1 * 6/2010 Goudy, Jr. ..... B03C 3/08 204/164
2011/0027734 A1 * 2/2011 Hartwick ..... F23C 99/001 431/264
2012/0100497 A1 * 4/2012 Joo ..... F23D 11/443 431/258
2012/0317985 A1 * 12/2012 Hartwick ..... F23C 5/14 60/722
2013/0040067 A1 * 2/2013 Kennedy ..... B22F 3/115 427/474
2013/0071794 A1 3/2013 Colannino et al.
2013/0230810 A1 9/2013 Goodson et al.
2013/0260321 A1 * 10/2013 Colannino ..... F23Q 3/00 431/2
2013/0291552 A1 11/2013 Smith et al.
2013/0323661 A1 12/2013 Goodson et al.
2013/0333279 A1 12/2013 Osler et al.
2013/0336352 A1 12/2013 Colannino et al.
2014/0051030 A1 2/2014 Colannino et al.
2014/0076212 A1 3/2014 Goodson et al.
2014/0080070 A1 3/2014 Krichtafovitch et al.
2014/0162195 A1 6/2014 Lee et al.
2014/0162198 A1 6/2014 Krichtafovitch et al.
2014/0170569 A1 6/2014 Anderson et al.
2014/0170571 A1 6/2014 Casasanta, III et al.
2014/0170575 A1 6/2014 Krichtafovitch
2014/0170576 A1 6/2014 Colannino et al.
2014/0196368 A1 7/2014 Wiklof
2014/0208758 A1 7/2014 Breidenthal et al.
2014/0212820 A1 7/2014 Colannino et al.
2014/0216401 A1 8/2014 Colannino et al.
2014/0227645 A1 8/2014 Krichtafovitch et al.
2014/0227646 A1 8/2014 Krichtafovitch et al.
2014/0227649 A1 * 8/2014 Krichtafovitch ..... F23N 5/00 431/253
2014/0255856 A1 9/2014 Colannino et al.
2014/0272731 A1 9/2014 Breidenthal et al.
2014/0287368 A1 9/2014 Krichtafovitch et al.
2014/0295094 A1 10/2014 Casasanta, III
2014/0335460 A1 11/2014 Wiklof et al.
2015/0079524 A1 3/2015 Colannino et al.
2015/0104748 A1 4/2015 Dumas et al.
2015/0107260 A1 4/2015 Colannino et al.
2015/0118629 A1 4/2015 Colannino et al.
2015/0121890 A1 5/2015 Colannino et al.
2015/0140498 A1 5/2015 Colannino
2015/0147704 A1 5/2015 Krichtafovitch et al.
2015/0147705 A1 5/2015 Colannino et al.
2015/0219333 A1 8/2015 Colannino et al.
2015/0226424 A1 8/2015 Breidenthal et al.
2015/0276211 A1 10/2015 Colannino et al.
2015/0338089 A1 * 11/2015 Krichtafovitch ..... F23N 5/00 431/8
2015/0345780 A1 12/2015 Krichtafovitch
2015/0345781 A1 12/2015 Krichtafovitch et al.
2015/0362177 A1 12/2015 Krichtafovitch et al.
2015/0362178 A1 12/2015 Karkow et al.

(56) References Cited

U.S. PATENT DOCUMENTS

| | | | | |
|---|---|---|---|---|
| 2015/0369476 | A1* | 12/2015 | Wiklof | F23C 99/001 431/8 |
| 2016/0018103 | A1 | 1/2016 | Karkow et al. | |
| 2016/0040872 | A1 | 2/2016 | Colannino et al. | |
| 2016/0047542 | A1* | 2/2016 | Wiklof | F23C 99/001 431/2 |
| 2016/0047547 | A1* | 2/2016 | Barels | F23N 1/002 122/14.2 |
| 2016/0091200 | A1 | 3/2016 | Colannino et al. | |
| 2016/0123577 | A1 | 5/2016 | Dumas et al. | |
| 2016/0138799 | A1* | 5/2016 | Colannino | F23D 14/84 431/2 |
| 2016/0161110 | A1 | 6/2016 | Krichtafovitch et al. | |
| 2016/0161115 | A1 | 6/2016 | Krichtafovitch et al. | |
| 2016/0215974 | A1 | 7/2016 | Wiklof | |
| 2016/0273763 | A1 | 9/2016 | Colannino et al. | |
| 2016/0273764 | A1 | 9/2016 | Colannino et al. | |
| 2016/0290633 | A1 | 10/2016 | Cherpeske et al. | |
| 2016/0290639 | A1 | 10/2016 | Karkow et al. | |
| 2016/0298836 | A1 | 10/2016 | Colannino et al. | |
| 2016/0363315 | A1 | 12/2016 | Colannino et al. | |
| 2017/0146233 | A1 | 5/2017 | Krichtafovitch | |
| 2017/0146234 | A1 | 5/2017 | Krichtafovitch et al. | |

FOREIGN PATENT DOCUMENTS

| | | | | |
|---|---|---|---|---|
| WO | WO 1995/034784 | | 12/1995 | |
| WO | WO-2014005143 | A1 * | 1/2014 | F23C 99/001 |
| WO | WO 2015/089306 | | 6/2015 | |
| WO | WO 2015/123683 | | 8/2015 | |
| WO | WO 2016/140681 | | 9/2016 | |

* cited by examiner

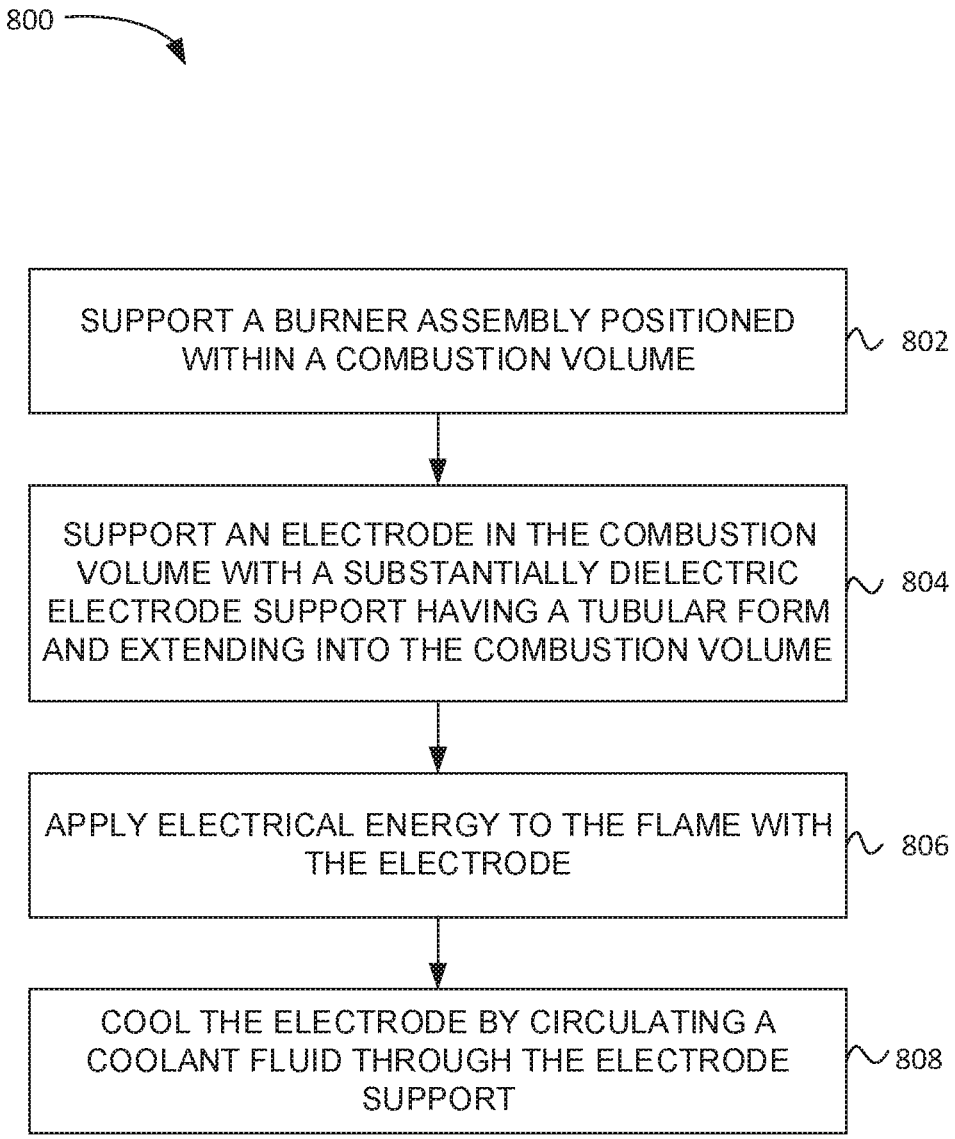
800
SUPPORT A BURNER ASSEMBLY POSITIONED WITHIN A COMBUSTION VOLUME
802
SUPPORT AN ELECTRODE IN THE COMBUSTION VOLUME WITH A SUBSTANTIALLY DIELECTRIC ELECTRODE SUPPORT HAVING A TUBULAR FORM AND EXTENDING INTO THE COMBUSTION VOLUME
804
APPLY ELECTRICAL ENERGY TO THE FLAME WITH THE ELECTRODE
806
COOL THE ELECTRODE BY CIRCULATING A COOLANT FLUID THROUGH THE ELECTRODE SUPPORT
808

COOLED CERAMIC ELECTRODE SUPPORTS

CROSS REFERENCE TO RELATED APPLICATIONS

The present application claims priority benefit from U.S. Provisional Patent Application No. 62/376,662, entitled "COOLED CERAMIC ELECTRODE SUPPORTS," filed Aug. 18, 2016; which, to the extent not inconsistent with the disclosure herein, is incorporated by reference.

BACKGROUND

Combustion systems are employed in a vast number of applications, including, for example, domestic and commercial HVAC, smelters, foundries, and refineries, chemical manufacturing, research operations, power generation, etc. In many applications, electrical energy is applied to a combustion reaction.

SUMMARY

According to an embodiment, a combustion system is provided, including a burner assembly configured to support a flame within a combustion volume, an electrode positioned within the combustion volume and configured to apply electrical energy to a flame supported by the burner assembly, and a dielectric electrode support having a tubular form, extending into the combustion volume and configured to support the electrode and further configured to be cooled by a coolant fluid circulated therethrough.

According to an embodiment, the electrode support extends through a furnace wall into the combustion volume, and has first and second coolant ports in fluid communication with a coolant channel extending within the tubular form of the electrode support.

According to an embodiment, the first coolant port is in fluid communication with a fluid coolant source. During operation, a fluid coolant flows through the electrode support, holding a temperature of the electrode to within a selected range.

According to an embodiment, the fluid coolant source includes a gas compressor configured to deliver a gas coolant to the electrode support.

According to an embodiment, the gas compressor includes a blower configured to draw and deliver ambient air as the fluid coolant to the electrode support.

According to an embodiment, the electrode support is one of a plurality of electrode supports, each configured to support a respective electrode within the combustion volume.

According to another embodiment, the electrode support is configured to support the weight of the electrode, while a second electrode support is positioned and configured to hold the electrode at a selected orientation.

According to an embodiment, a method includes supporting a flame with a burner assembly positioned within a combustion volume and supporting an electrode in the combustion volume with a substantially dielectric electrode support having a tubular form and extending into the combustion volume. The method includes applying electrical energy to the flame with the electrode and cooling the electrode by circulating a coolant fluid through the electrode support.

BRIEF DESCRIPTION OF THE DRAWINGS

FIG. 8 is a flow diagram of a method for operating a combustion system, according to an embodiment.

DETAILED DESCRIPTION

Figure 1:
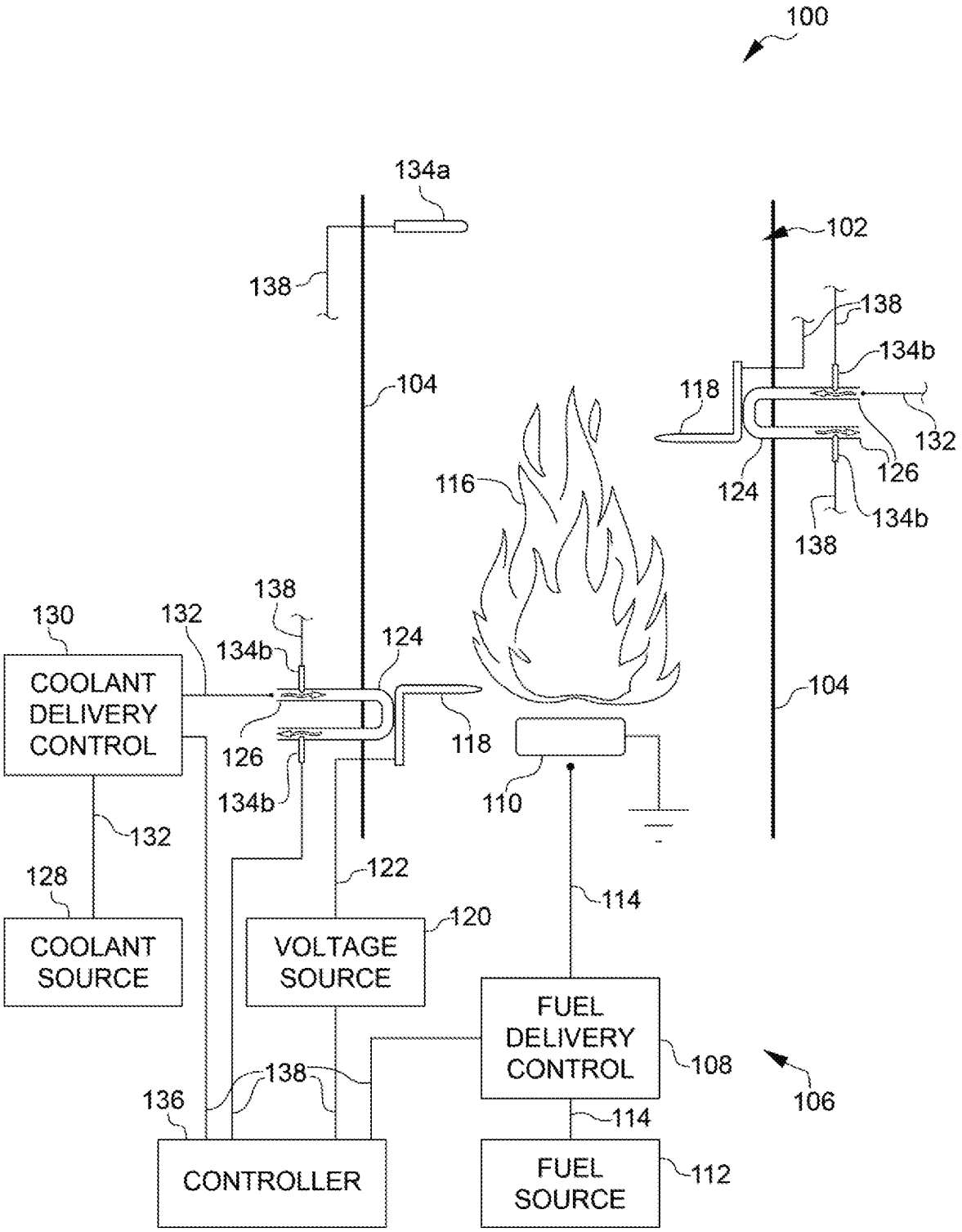
FIG. 1 is a diagrammatic side view of a portion of a combustion system, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Some combustion systems are configured to operate at very high temperatures, and in some of these systems, it is desirable to position one or more electrodes very close to a flame within the systems. One concern in such systems is the selection of a suitable material for supports intended to hold the electrodes within the combustion volume. The electrode supports should preferably be made of a material capable of retaining its strength and stiffness at or near the maximum operating temperature of the particular system, to resist deformation during operation. The material should also be a good insulator, inasmuch as the electrodes can be charged to extremely high voltage potentials, sometimes on the order of tens of thousands of volts. Under these conditions, the material should have a high breakdown voltage, in order to resist breakdown failure, and should also preferably be highly electrically resistive, to minimize parasitic currents via the electrode support to other system components, such as, e.g., a furnace wall.

Few dielectric materials are suitable for supporting electrodes within the combustion volume of a furnace, particularly in furnaces that operate at high temperatures. Most simply cannot tolerate high temperatures. Ceramic is a preferred support material because many ceramic formulations retain their rigidity at temperatures above 1500 degrees F. Additionally, ceramics can be formed using a number of different processes, including, e.g., various molding processes, extrusion, machining, and 3-D printing. However, the inventor has found that many ceramics increase in electrical conductivity at high temperatures, to a degree that varies according to the temperature and the formulation of the ceramic. Very often, as a ceramic electrode support is heated, its electrical resistance decreases, and it begins to act as a parasitic current path to ground, via furnace walls and other structures. In many systems, the electrodes do not discharge a current through the flame, so the current requirements of the power supply can be very low. However, when a parasitic current path exists, the power supply must be capable of meeting the additional current draw while still applying the nominal voltage potential to the electrodes. Thus, operational costs are increased, because of the additional power required, and equipment costs are higher, because of the more powerful voltage supply required.

Safety is another concern, because components of a system can become electrically charged if they are not adequately grounded.

The inventor has conceived and tested cooled electrode supports, which can support electrodes in extremely high temperature environments without losing their dielectric characteristics.

FIG. 1 is a diagrammatic side view of a portion of a combustion system 100 according to an embodiment. The combustion system 100 includes a combustion volume 102 defined in part by furnace walls 104. A burner assembly 106 includes fuel delivery control element 108 and a flame support element 110. The fuel delivery control element 108 is configured to receive fuel from a fuel source 112, via a fuel line 114 and deliver the fuel at a controlled rate to the flame support element 110, which in turn is configured to support a flame 116 within the combustion volume 102.

The burner assembly 106 is not shown in significant detail because the details can vary widely, according to the type of combustion system, the nominal capacity of the system and burner assembly, the fuel used, etc. Burner assemblies configured according to the many variations of systems are very well known in the art. For example, according to various embodiments, the flame support element 110 can include a nozzle optimized to output liquid fuel, gaseous fuel, or solid fuel particles entrained in a flow of liquid or gas, or can be configured to include a grate configured to receive other types of solid fuels. Similarly, according to some embodiments, the fuel delivery control element 108 can be configured according to any of a number of designs, and can include, for example, a valve configured to regulate a flow of fluid, or can be configured for use with solid fuels, and can comprise a screw conveyor or a rotating chain grate, etc.

Returning to FIG. 1, a plurality of electrodes 118 are positioned within the combustion volume 102, electrically coupled to a voltage source 120 via an electrical connector 122, and configured to apply electrical energy to the flame 116. The electrodes 118 are coupled to electrode supports 124, which extend through the furnace walls 104 and support the electrodes at selected locations within the combustion volume 102. The electrode supports 124 are tubular, and include coolant ports 126 configured to receive coolant from a coolant source 128 via a coolant delivery control element 130 and coolant transmission lines 132.

A plurality of sensors 134 are positioned in and/or around the combustion volume 102 and configured to monitor various ones of a large number of parameters associated with the combustion system 100. For example, a first sensor 134*a* is positioned and configured to monitor combustion characteristics of the flame 116, which can include emissions of CO, $CO_2$, and $NO_X$, flame temperature, energy emission spectra, etc. Second sensors 134*b* are positioned at the coolant ports 126 of the electrode supports 124, and configured to detect the temperature of coolant entering and exiting the supports 124.

A controller 136 is provided, configured to receive input and control various aspects of the operation of the combustion system 100, via control connectors 138. In the present example, the controller 136 is operatively coupled to the fuel delivery control element 108, the voltage source 120, the coolant delivery control element 130, and the sensors 134, and is configured to regulate fuel delivered to the flame support element 110, voltage signals applied to the electrodes 118, and the flow of coolant through the electrode supports 124, in part on the basis of data received from the sensors 134.

In the embodiment of FIG. 1, two electrodes 118 are shown, having a relatively long tapered shape, and are positioned at different distances from the flame support element 110. These details are provided as examples, only. Other embodiments are envisioned, in which the number, shape and positions of the electrode differs from the example of FIG. 1.

With regard to the flame support elements 110, their shape and configuration can vary according to the details of a particular embodiment, as shown, for example, in the embodiment described below with reference to the embodiment of FIGS. 2A and 2B. Furthermore, according to various embodiments, the structure and complexity of the coolant delivery control element 130 can vary. For example, according to an embodiment, the coolant source 128 includes a reservoir configured to hold a liquid coolant. The coolant delivery control element 130 includes a fluid pump configured to pump fluid into a coolant port 126 of each electrode support 124. The other coolant port 126 of each electrode support 124 is in fluid communication with the coolant source 128, creating a closed circuit, in which fluid is drawn from and returned to the fluid source. According to another embodiment, the coolant delivery control element 130 includes a simple blower configured to introduce ambient air into one of the coolant ports 126 of each electrode support 124, while the air exiting the other port 126 simply returns to the area surrounding the furnace.

According to an embodiment, the controller 136 is configured to monitor the temperature of the coolant as it exits each electrode support 124, and to control the output of the coolant delivery control element 130 to maintain a temperature of the electrode supports 124 below a selected value. According to another embodiment, the volume of coolant is preselected to be sufficient to maintain temperature of the electrode supports 124 below the selected value, even while the combustion system 100 is operating at a maximum operating temperature. This obviates the need for the second temperature sensors 134*b* at the coolant ports 126 of the electrode supports 124, and also reduces the workload on the controller 136, which is not required to monitor the coolant temperature.

Many common and well understood elements shown and described with reference to FIG. 1 will not be shown or described in detail in other embodiments, for the sake of brevity. Nevertheless, it should be understood that any such elements may be employed, according to the design requirements of the particular embodiment.

Figure 2A:
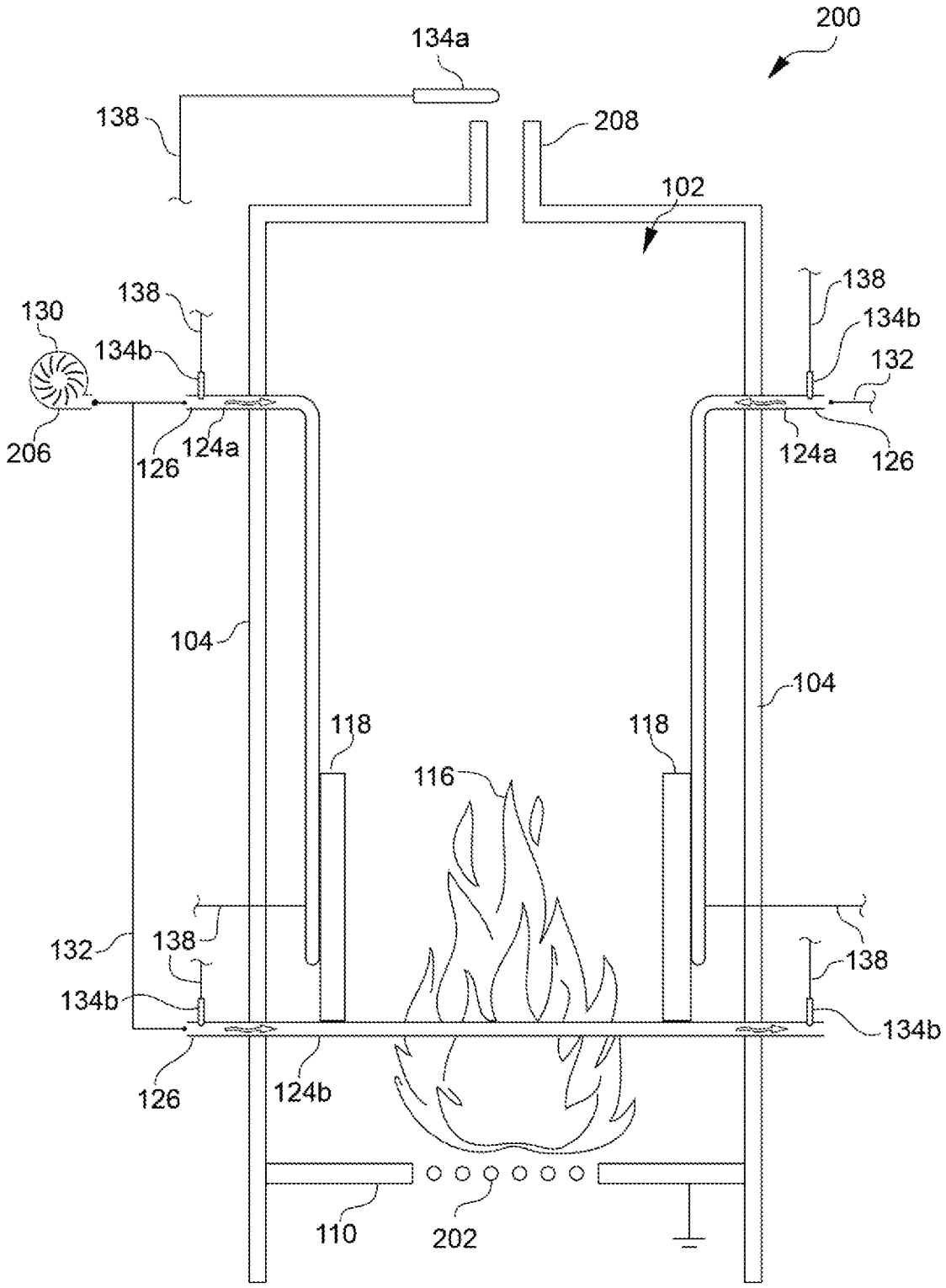
FIGS. 2A and 2B are diagrammatic views of a combustion system, according to another embodiment.
Figure 2B:
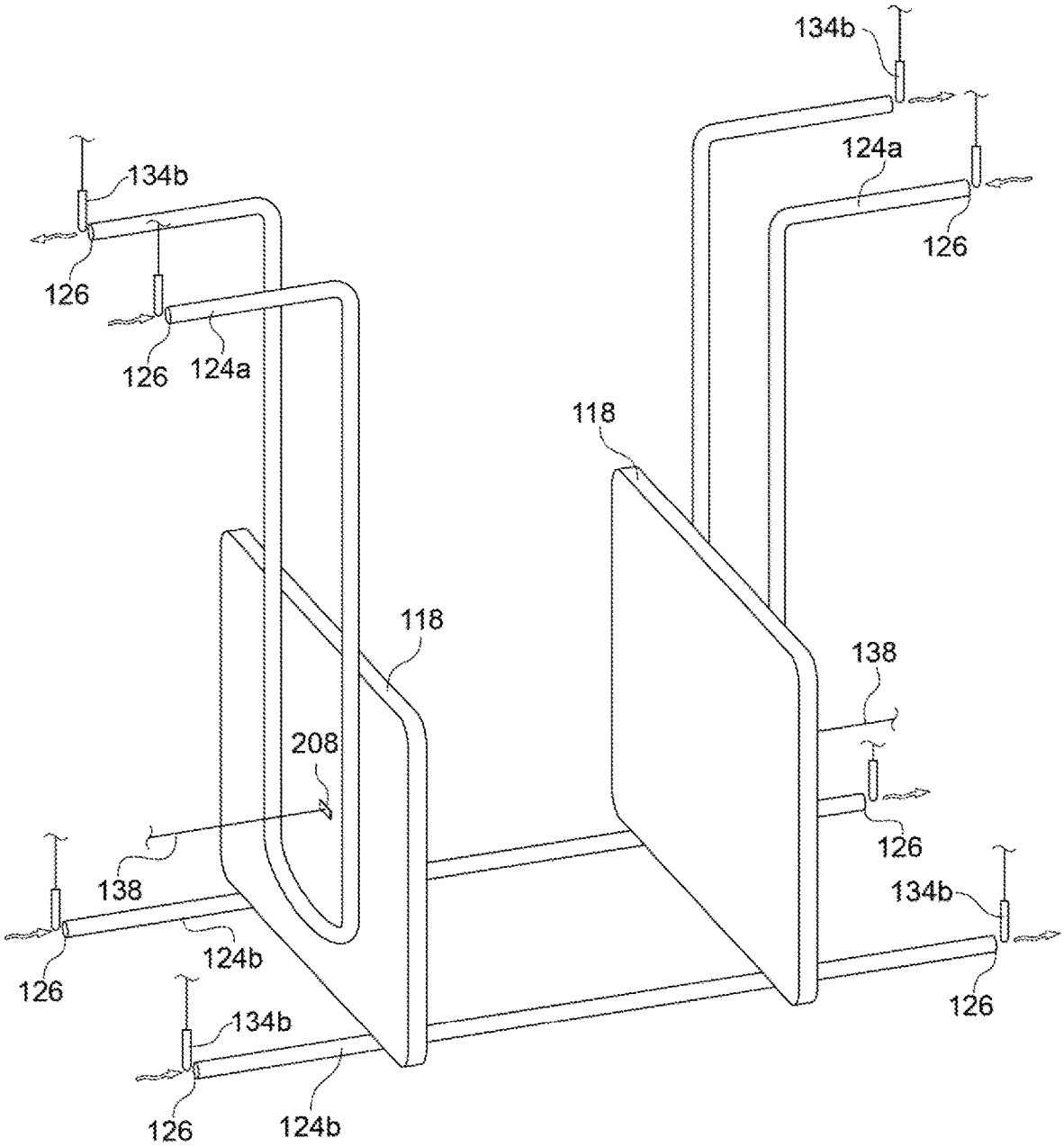

FIGS. 2A and 2B are diagrammatic views of a combustion system 200, according to an embodiment. FIG. 2A is a side view of the combustion system 200, while FIG. 2B is a perspective view showing additional details of selected elements of the combustion system 200. The combustion system 200 is similar to a configuration set up by the inventor in order to test the practical viability of aspects of the invention.

The combustion system 200 includes a burner assembly 106 configured to burn solid fuel, and in which the flame support element 110 comprises a grate 202 to which the solid fuel is delivered via any of a number of mechanisms known in the art. Electrodes 118 are shaped as plate electrodes, with a control connector 138 coupled to each electrode 118 via a contact point 204 embedded in the side of the respective electrode 118 opposite the flame 116, as shown in FIG. 2B. The electrodes 118 are supported in the combustion volume 102 by two sets of electrode supports 124. First electrode supports 124*a* have a "U" shape, with the legs of the U extending horizontally through the furnace wall 104, and the portions of the first electrode supports 124*a* that are inside the combustion volume 102 bending into a vertical position (see FIG. 2B). The first electrode supports 124*a* hold the electrodes 118 in a selected orientation relative to the flame 116. Second electrode supports 124*b* are substantially straight, and extend, parallel to each other, across the combustion volume 102 and through opposite furnace walls 104 of the combustion system 200. The second electrode supports 124*b* support most of the weight of the electrodes 118.

The coolant delivery control element 130 includes a blower 206 operatively coupled to a coolant port 126 of each electrode support 124. Second sensors 134*b* are positioned at the coolant ports 126 of the electrode supports 124 and configured to detect the temperature of coolant entering and exiting the supports 124. A first sensor 134*a* is positioned to monitor flue gases exiting the combustion volume 102 via a stack 208, and is configured to produce one or more signals representative of respective combustion characteristics of the flame 116.

In operating a test furnace in which electrodes were supported on refractory ceramic supports (performing tests that were not related to the subject of the present disclosure), the inventor determined that, in high-temperature conditions, a significant current flowed through the supports, which could skew the test results. The inventor conceived of aspects of the present invention as a solution to this problem, but recognized that the potential benefits would extend beyond the improved accuracy of a test furnace.

Using a test furnace configured substantially as the combustion system 200 of FIGS. 2A and 2B, the inventor performed tests that demonstrated that in a furnace approaching 2000 degrees F., electrode supports similar to the electrode supports 124*b* of FIGS. 2A and 2B could be maintained, generally, at temperatures below about 550 degrees F., while the electrode supports corresponding to the electrode supports 124*a* were easily maintained at much lower temperatures. On the other hand, without the active cooling of the electrodes, they easily reached temperatures exceeding 1500 degrees F.

Alumina is one example of a ceramic that is often used in high-temperature applications. At room temperature, alumina has a resistivity of more than $10^{14}$ Ωcm. At 600 degrees F., the resistivity is around $10^{10}$ Ωcm, while at 1500 degrees F., the resistivity drops to around $10^{5}$ Ωcm.

In conducting the tests, the inventor did not employ the number of second sensors 134*b* shown in FIGS. 2A and 2B, but instead positioned a smaller number of sensors, over the course of several tests, to obtain the desired values.

One significant advantage of the use of cooled electrode supports is that the choice of materials is significantly increased, because the temperature of the supports can be held below the transition temperature of many different materials.

Turning now to FIGS. 3A to 6, examples are shown of support stock from which electrode supports can be made, according to respective embodiments. Other profiles are contemplated, and many other shapes can be devised to meet the requirements of specific applications, all of which are within the scope of the invention.

Figure 3A:
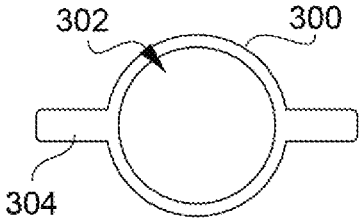
FIGS. 3A to 6 are diagrammatic sectional views of support stock from which electrode supports can be made, according to respective embodiments.
Figure 3B:
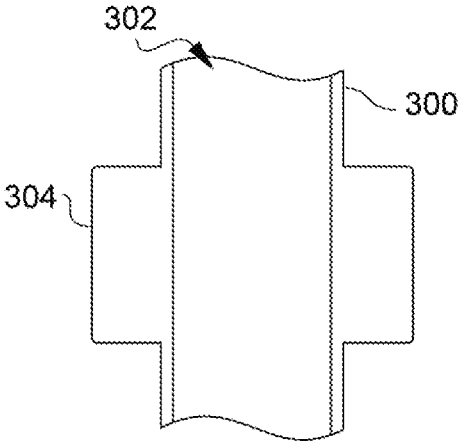

FIG. 3A is a diagrammatic transverse sectional view of a support stock 300, according to an embodiment. FIG. 3B is a diagrammatic longitudinal sectional view of the support stock 300 of FIG. 3A. The support stock 300 includes a coolant channel 302 configured to transport a coolant while an electrode support is in operation. Tabs 304 extend on opposite sides for a selected length, as shown in the example of FIG. 3B. The tabs 302 are configured to receive mounting clips or other attaching means, to securely hold an electrode in a combustion volume.

Figure 4:
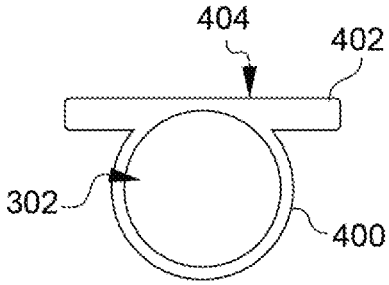

FIG. 4 is a diagrammatic transverse sectional view of a support stock 400, according to an embodiment. The support stock 400 of FIG. 4 includes a tangential plate 402. In addition to being configured to receive mounting clips, the tangential plate 402 provides a planar surface 404 against which an electrode can be mounted, to control an orientation of the electrode. The tangential plate 402 can extend for a selected distance, as described above with reference to the tabs 304 of the support stock 300, or can extend the length of the stock 400.

Figure 5:
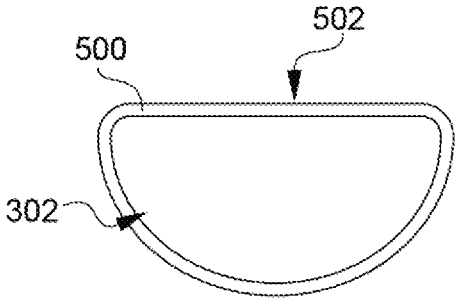

FIG. 5 is a diagrammatic transverse sectional view of a support stock 500, according to another embodiment. In transverse profile, the support stock 500 has a "D" shape, so a planar surface 502 is formed, and to which an electrode can be mounted in a desired orientation.

Figure 6:
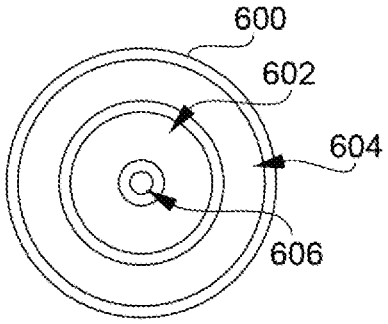

FIG. 6 is a diagrammatic transverse sectional view of a support stock 600, according to a further embodiment. The support stock 600 includes first and second coolant channels 602, 604 that are concentric, and an optional concentric core channel 606. The first and second coolant channels 602, 604 enable the support stock 600 to transport coolant in two directions, simultaneously. The core channel 606 provides an insulated passage for an electrical connector, etc.

Figure 7:
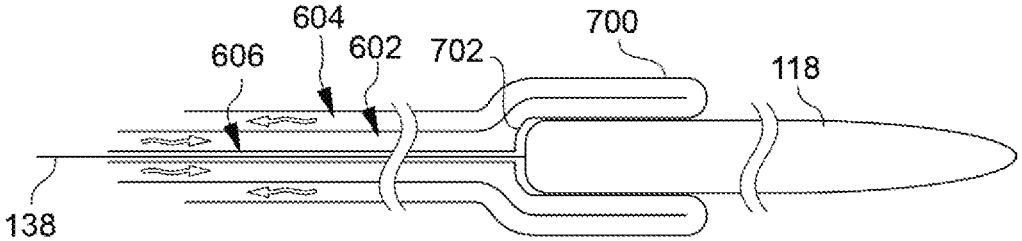
FIG. 7 is a diagrammatic longitudinal sectional view of an electrode support, according to an embodiment, showing an example of an electrode design that employs the support stock of FIG. 6.

FIG. 7 is a diagrammatic longitudinal sectional view of an electrode support 700, according to an embodiment, showing an example of an electrode design that employs a support stock like that described above with reference to FIG. 6. In the example of FIG. 7, a long, narrow electrode 118 is positioned in a socket 702 of the electrode support 700. Coolant enters the electrode support 700 via the first coolant channel 602, and exits via the second coolant channel 604. An end of a control connector 138 is embedded in the electrode 118 and extends from the electrode support 700 via the core channel 606. Tension on the control connector 138 holds the electrode 118 in position.

FIG. 8 is a flow diagram of a method 800 for operating a combustion system, according to an embodiment. At 802 a flame is supported with a burner assembly positioned within a combustion volume. At 804, an electrode is supported in the combustion volume with a substantially dielectric electrode support having a tubular form and extending into the combustion volume. At 806, electrical energy is applied to the flame with the electrode. At 808, the electrode is cooled by circulating a coolant fluid through the electrode support.

According to an embodiment, the combustion volume is defined in part by a furnace wall. The electrode support extends through the furnace wall into the combustion volume. The electrode support includes coolant ports in fluid communication with an interior of the electrode support, the coolant ports being positioned outside the combustion volume.

According to an embodiment, the method includes delivering the coolant fluid to an interior of the electrode support from a coolant source positioned outside the combustion volume.

According to an embodiment, the method includes delivering the coolant fluid to the interior of the electrode support from the coolant source via a coolant port of the electrode support positioned outside the combustion volume.

According to an embodiment, delivering the coolant fluid to the interior of the electrode support includes delivering a pressurized gas from the coolant source with a gas compressor.

According to an embodiment, the gas compressor is a blower.

According to an embodiment, the method includes drawing and delivering ambient air as the fluid coolant to the electrode support with the blower.

According to an embodiment, the method includes controlling an operation of the fluid coolant source with a controller.

According to an embodiment, the method includes controlling operation of the fluid coolant source with the controller based at least in part on a temperature of fluid coolant exiting the electrode support.

According to an embodiment, the method includes sensing the temperature of the coolant fluid exiting the electrode support and providing a signal to the controller indicative of the temperature of coolant fluid exiting the electrode support.

According to an embodiment, the method includes controlling a voltage signal applied to the electrode with the controller.

According to an embodiment, the method includes controlling the voltage signal applied to the electrode at least in part based on combustion parameters of the flame.

According to an embodiment, the method includes providing a signal to the controller from a sensor indicative of a combustion parameter of the flame.

According to an embodiment, the method includes supporting the electrode with a plurality of electrode supports.

According to an embodiment, supporting the electrode includes supporting the weight of the electrode by a first one of the plurality of electrode supports while holding the electrode in position by a second one of the electrode supports.

According to an embodiment, the method includes supporting the weight of the electrode by the first one and a third one of the plurality of electrode supports.

According to an embodiment, the method includes supporting a plurality of electrodes in the combustion volume with a plurality of electrode supports. The electrode can be one of a plurality of electrodes. According to an embodiment, the method includes applying electrical energy to the flame with the plurality of electrodes and cooling the plurality of electrode supports by passing the coolant fluid through respective interiors of the plurality of electrode supports.

Where employed by the specification or claims to refer to a quantity that is applied to a combustion reaction via a charge element, such as an electrode, the term electrical energy is to be construed as including within its scope any form of energy or potential energy that might reasonably be applied to the combustion reaction, given the structure and configuration of the charge element upon which the language in question can be read, and may include, for example, electromagnetic energy, a charge, a voltage, an electrical field, etc.

The abstract of the present disclosure is provided as a brief outline of some of the principles of the invention according to one embodiment, and is not intended as a complete or definitive description of any embodiment thereof, nor should it be relied upon to define terms used in the specification or claims. The abstract does not limit the scope of the claims.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

a burner assembly configured to support a flame within a combustion volume;

an electrode positioned within the combustion volume and configured to apply electrical energy to a flame supported by the burner assembly; and three or more electrode supports each having a tubular form, extending into the combustion volume and configured to support the electrode and further configured to be cooled by a coolant fluid circulated therethrough, each electrode support being substantially dielectric, wherein the weight of the electrode is supported by a first one and a second one of the three or more electrode supports while the electrode is held in position by a third one of the three or more electrode supports.

2. The combustion system of claim 1, wherein:

the combustion volume is defined in part by a furnace wall;

at least one of the three or more electrode supports extends through the furnace wall into the combustion volume; and the at least one electrode support includes coolant ports in fluid communication with an interior of the at least one electrode support, the coolant ports being positioned outside the combustion volume.

3. The combustion system of claim 2, comprising:

a fluid coolant source having an output operatively coupled to one of the coolant ports and configured to deliver a fluid coolant to the at least one electrode support.

4. The combustion system of claim 3, wherein the fluid coolant source includes a gas compressor configured to deliver a pressurized gas to the at least one electrode support.

5. The combustion system of claim 4, wherein the gas compressor includes a blower configured to draw and deliver ambient air as the fluid coolant to the at least one electrode support.

6. The combustion system of claim 2, comprising:

a controller configured to control operation of the fluid coolant source.

7. The combustion system of claim 6, wherein the controller is configured to control operation of the fluid coolant source based at least in part on a temperature of fluid coolant exiting the at least one electrode support.

8. The combustion system of claim 7, comprising a sensor configured to provide a signal to the controller indicative of a temperature of fluid coolant exiting the at least one electrode support.

9. The combustion system of claim 6, wherein the controller is configured to control a voltage signal applied to the electrode.

10. The combustion system of claim 9, wherein the controller is configured to control the voltage signal applied to the electrode at least in part based on combustion parameters of the flame supported by the burner assembly.

11. The combustion system of claim 10, comprising a sensor configured to provide a signal to the controller indicative of a combustion parameter of the flame supported by the burner assembly.

12. The combustion system of claim 1, wherein the electrode is one of a plurality of electrodes.

13. The combustion system of claim 12, wherein each of the plurality of electrodes is supported by a respective one of the three or more electrode supports.

14. The combustion system of claim 1, wherein at least one of the electrode supports is made of a ceramic material having an electrical conductivity that increases with temperature.

15. The combustion system of claim 1, wherein at least one of the electrode supports is made of quartz.

16. A method, comprising:

supporting a flame with a burner assembly positioned within a combustion volume;

supporting an electrode in the combustion volume with three or more substantially dielectric electrode supports each having a tubular form and extending into the combustion volume;

applying electrical energy to the flame with the electrode; and cooling the electrode by circulating a coolant fluid through at least one of the three or more electrode supports, wherein said supporting the electrode includes supporting the weight of the electrode by a first one and a second one of the three or more electrode supports and holding the electrode in position by a third one of the three or more electrode supports.

17. The method of claim 16, wherein:

the combustion volume is defined in part by a furnace wall;

the at least one electrode support extends through the furnace wall into the combustion volume; and the at least one electrode support includes coolant ports in fluid communication with an interior of the at least one electrode support, the coolant ports being positioned outside the combustion volume.

18. The method of claim 16, further comprising delivering the coolant fluid to an interior of at least one of the three or more electrode supports from a coolant source positioned outside the combustion volume.

19. The method of claim 18, comprising delivering the coolant fluid to the interior of the at least one electrode support from the coolant source via a coolant port of the at least one electrode support positioned outside the combustion volume.

20. The method of claim 19, wherein delivering the coolant fluid to the interior of the at least one electrode support includes delivering a pressurized gas from the coolant source with a gas compressor.

21. The method of claim 20, wherein the gas compressor is a blower.

22. The method of claim 21, further comprising drawing and delivering ambient air as the fluid coolant to the at least one electrode support with the blower.

23. The method of claim 16, further comprising controlling operation of the fluid coolant source with a controller.

24. The method of claim 23, further comprising controlling operation of the fluid coolant source with the controller based at least in part on a temperature of fluid coolant exiting the electrode support.

25. The method of claim 24, comprising sensing the temperature of the coolant fluid exiting the at least one electrode support and providing a signal to the controller indicative of the temperature of coolant fluid exiting the at least one electrode support.

26. The method of claim 23, further comprising controlling a voltage signal applied to the electrode with the controller.

27. The method of claim 26, further comprising controlling the voltage signal applied to the electrode at least in part based on combustion parameters of the flame.

28. The method of claim 27, further comprising providing a signal to the controller from a sensor indicative of a combustion parameter of the flame.

29. The method of claim 16, further comprising:

supporting a plurality of electrodes in the combustion volume with the three or more electrode supports, wherein the electrode is one of the plurality of electrodes; and applying electrical energy to the flame with the plurality of electrodes; and cooling the each of the three or more electrode supports by passing the coolant fluid through respective interiors of the three or more electrode supports.

* * * * *